US009303837B2

(12) United States Patent
Watanabe

(10) Patent No.: US 9,303,837 B2
(45) Date of Patent: Apr. 5, 2016

(54) VEHICULAR LAMP HAVING A TRANSLUCENT MEMBER HAVING A CENTER REGION THAT SERVERS AS A LENS-LIKE DIRECT LIGHT CONTROL PORTION

(71) Applicant: KOITO MANUFACTURING CO., LTD., Tokyo (JP)

(72) Inventor: Tomoyuki Watanabe, Shizuoka (JP)

(73) Assignee: KOITO MANUFACTURING CO., LTD., Tokyo (JP)

( * ) Notice: Subject to any disclaimer, the term of this patent is extended or adjusted under 35 U.S.C. 154(b) by 0 days.

(21) Appl. No.: 14/553,802

(22) Filed: Nov. 25, 2014

(65) Prior Publication Data

US 2015/0153015 A1 Jun. 4, 2015

(30) Foreign Application Priority Data

Nov. 25, 2013 (JP) ..... 2013-242492

(51) Int. Cl.

| | |
|---|---|
| ***F21S 8/10*** | (2006.01) |
| *F21W 101/10* | (2006.01) |
| *F21Y 101/02* | (2006.01) |

(52) U.S. Cl.

CPC ..... *F21S 48/2212* (2013.01); *F21S 48/215* (2013.01); *F21S 48/236* (2013.01); *F21S 48/24* (2013.01); *F21W 2101/10* (2013.01); *F21Y 2101/02* (2013.01)

(58) Field of Classification Search

CPC ..... F21S 48/2212; F21S 48/24; F21S 48/215; F21S 48/236

USPC ..... 362/518

See application file for complete search history.

(56) References Cited

U.S. PATENT DOCUMENTS

2005/0152153 A1 7/2005 Amano

FOREIGN PATENT DOCUMENTS

JP 4497348 B2 7/2010

*Primary Examiner* — Joseph L Williams

(74) *Attorney, Agent, or Firm* — Osha Liang LLP

(57) ABSTRACT

A vehicular lamp has a light-emitting element facing a forward direction of the lamp, and a translucent member that covers the light-emitting element from a front side. The translucent member has a center region located forward of the light-emitting element that serves as a lens-like direct light control portion. The translucent member has a peripheral region surrounding the center region that serves as a reflecting light control portion in which light emitted from the light-emitting element and incident on the translucent member is internally reflected forward by a rear surface of the translucent member and emitted forward from a front surface of the translucent member. The direct light control portion is configured such that light emitted from the direct light control portion has a light intensity distribution in which light intensity is highest in a direction at a first required angle from the forward direction of the lamp.

7 Claims, 7 Drawing Sheets

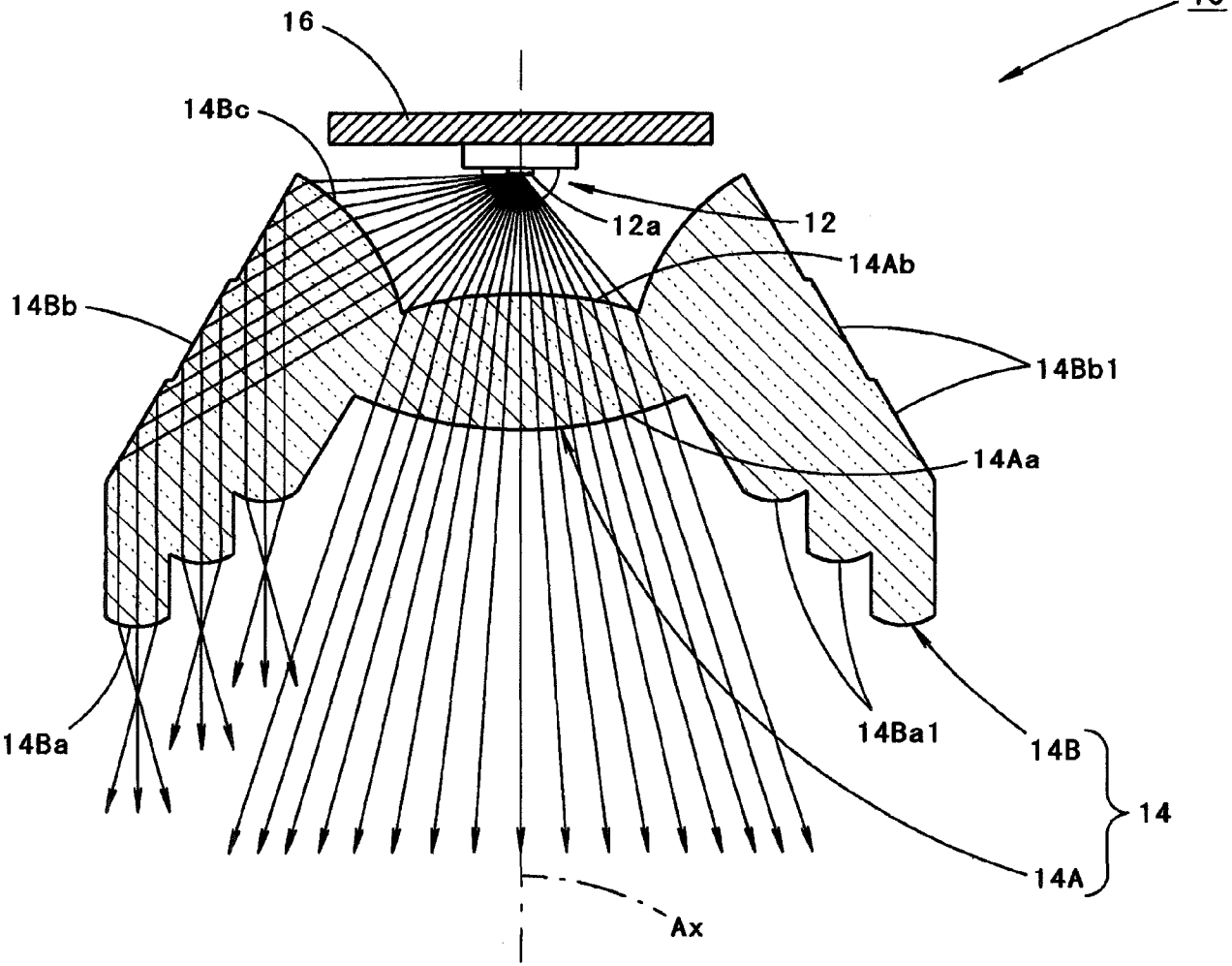
FIG. 2
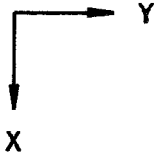

I
Ah'
Ah
L
αh
αh
R

I
Bh
L
βh
βh
R

I
Ah'+Bh
Ah+Bh
Imax
Imin
L
θh
θh
R

I
Av
U
αv
αv
D

I
Bv
U
βv
βv
D

I
Av+Bv
Imax
Imin
U
θv
θv
D

I
Ch
L
γh
R

I
Bh
L
βh
R

I
Ch+Bh
Imax
Imin
L
θh
θh
R

I
Cv
U
γv
γv
D

I
Bv
U
βv
D

I
Cv+Bv
Imax
Imin
U
θv
θv
D

VEHICULAR LAMP HAVING A TRANSLUCENT MEMBER HAVING A CENTER REGION THAT SERVERS AS A LENS-LIKE DIRECT LIGHT CONTROL PORTION

BACKGROUND

1. Technical Field

The present invention relates to a vehicular lamp having a light-emitting element as a light source.

2. Related Art

Patent document 1, for example, describes a conventional structure of a vehicular lamp that has a light-emitting element as a light source. In the structure, a light-emitting element is disposed so as to face forward of the lamp, and a translucent member is disposed so as to cover the light-emitting element from the front side.

The translucent member described in Patent Document 1 has: a center region which is located forward of the light-emitting element, is in shape of a plane-convex lens, and serves as a direct light control portion; and a peripheral region which is located around the center region, serves as a reflecting light control portion that receives light from the light-emitting element and incident on the translucent member, internally reflects the light forward with the rear surface of the peripheral region, and then emits the light forward from the front surface of the peripheral region.

[Patent Document 1]

Japanese Patent No. 4497348

SUMMARY

It is desired that in vehicular lamps such as rear fog lamps, light be emitted with as uniform luminous intensity as possible within a certain angular range from the front direction of the lamp.

In the vehicular lamp described in "Patent document 1", light intensity is highest in the front direction of the lamp in the light intensity distributions of the light emitted from the direct light control portion and the reflecting light control portion. Accordingly, in the entire light intensity distribution obtained by synthesizing these light intensity distributions, light intensity is highest in the front direction of the lamp. This may make the light intensity distribution flat is difficult.

One or more embodiments of the present invention provides a vehicular lamp that has a translucent member provided with a direct light control portion and a reflecting light control portion, and that can emit light with relatively uniform luminous intensity within a certain angular range from the front direction of the lamp.

One or more embodiments of the present invention elaborates the configuration of a translucent member.

That is, in a vehicular lamp according to one or more embodiments of the present invention including a light-emitting element disposed to face forward of the lamp, and a translucent member disposed to cover the light-emitting element from a front side, the vehicular lamp is characterized in that in the translucent member, a center region located forward of the light-emitting element serves as a lens-like direct light control portion, in the translucent member, a peripheral region surrounding the center region serves as a reflecting light control portion in which light emitted from the light-emitting element and incident on the translucent member is internally reflected forward by a rear surface of the translucent member and emitted forward from a front surface of the translucent member, the direct light control portion is configured such that light emitted from the direct light control portion has a light intensity distribution in which light intensity is highest in a direction at a first required angle from a front direction of the lamp, and the reflecting light control portion is configured such that light emitted from the reflecting light control portion has a light intensity distribution in which light intensity is highest in a direction at a second required angle that is smaller than the first required angle.

The type of the "light-emitting element" should not be limited to a particular type. For example, light-emitting diode, laser diode can be used.

The shapes of the rear surface and the front surface of the "direct light control portion" should not be limited to specific shapes as long as the direct light control portion is formed in a lens-like shape, and in the light intensity distribution of the light emitted from the direct light control portion, light intensity is highest in the direction at the first required angle from the front surface of the lamp.

The shapes of the incident surface, rear surface, and the front surface of the "reflecting light control portion" should not be limited to specific shapes as long as the light emitted from the light-emitting element and incident on the translucent member is internally reflected forward by the rear surface, and then emitted forward from the front surface.

The "first required angle" should not be limited to a specific value. The value may be the same or different in any directions.

The "second required angle" should not be limited to a specific value as long as the angle is set to be smaller than the first required angles.

The translucent member of the vehicular lamp according to the present invention has the center region serving as the lens-like direct light control portion and the peripheral region serving as the reflecting light control portion. The direct light control portion is configured such that light emitted from the direct light control portion has a light intensity distribution in which light intensity is highest in a direction at a first required angle from the front direction of the lamp. In contrast, the reflecting light control portion is configured such that light emitted from the reflecting light control portion has a light intensity distribution in which light intensity is highest in a direction at a second required angle that is smaller than the first required angle.

Synthesizing the light intensity distribution of light emitted from the direct light control portion and the light intensity distribution of light emitted from the reflecting light control portion brings a light intensity distribution that is overall relatively flat light intensity distribution. Accordingly, the vehicular lamp can emit light with relatively uniform luminous intensity within a certain angular range from the front direction of the lamp.

In this way, according to one or more embodiments of the present invention, the vehicular lamp that includes the translucent member provided with the direct light control portion and the reflecting light control portion can emit light with relatively uniform luminous intensity within a certain angular range from the front direction of the lamp.

In the above configuration, if the value of the first required angle is set such that the horizontal angle from the front direction of the lamp is smaller than the vertical angle from the front direction of the lamp, it is possible to form the light distribution pattern, in which light is distributed with relatively uniform luminous intensity within a certain angular range from the front direction of the lamp, into a horizontally long distribution pattern. This makes it possible to obtain a light distribution pattern more suitable for vehicular lamps such as rear fog lamps.

In the above configuration, if the value of the second required angle is set to 0°, the light distribution pattern can be formed into a light distribution pattern having more uniform luminous intensity. The value of the second required angle is not necessarily set to 0° in a strict sense, but may be set to approximately 0°.

In the above configuration, if the direct light control portion is formed in the shape of a double convex lens, the light from the light-emitting element can be easily refracted at the rear surface and the front surface of the direct light control portion. This allows fine control of light deflection by which in the light intensity distribution of the light emitted from the direct light control portion, the light intensity is highest in the direction that is at the first required angle from the font direction of the lamp.

BRIEF DESCRIPTION OF THE DRAWINGS

FIG. 2 is a cross sectional view taken along line II-II in FIG. 1.

DETAILED DESCRIPTION

Embodiments of the present invention will be described with reference to the drawings. In embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid obscuring the invention.

Figure 1:
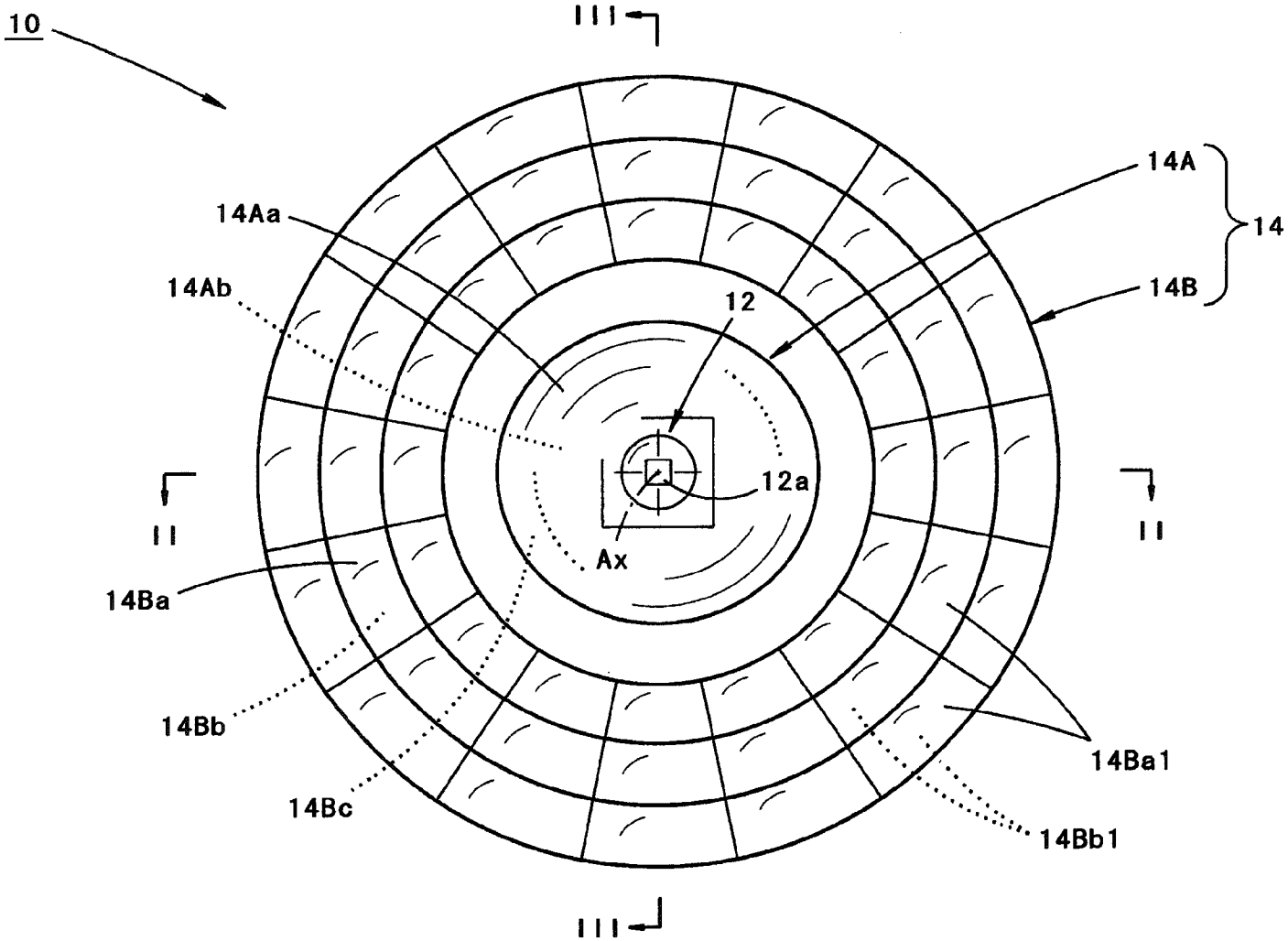
FIG. 1 is a front view of a vehicular lamp according to one or more embodiments of the present invention.
Figure 3:
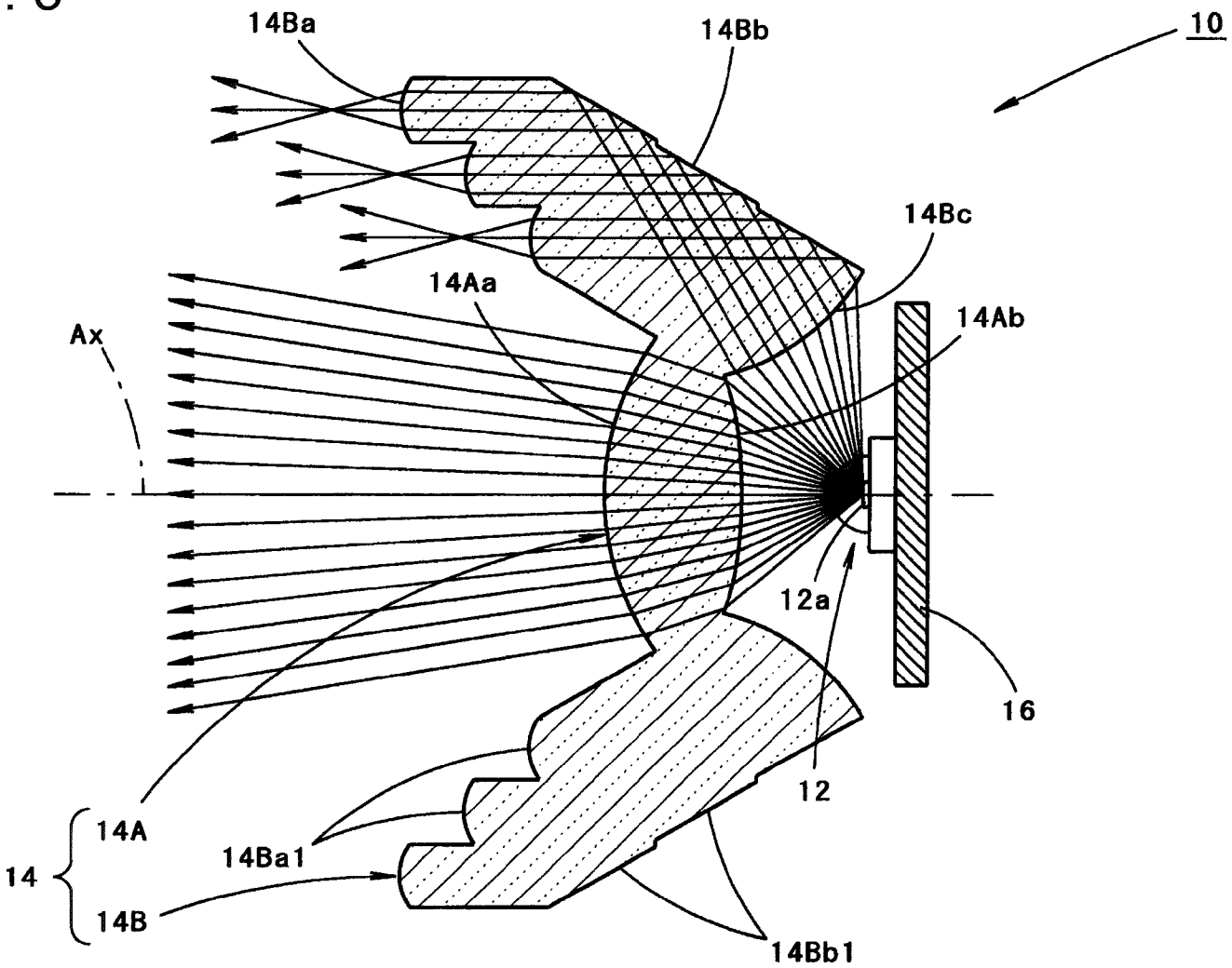
FIG. 3 is a cross sectional view taken along line III-III in FIG. 1.

FIG. 1 is a front view of a vehicular lamp 10 according to one or more embodiments of the present invention. FIG. 2 is a cross sectional view taken along line II-II in FIG. 1. FIG. 3 is a cross sectional view taken along line III-III in FIG. 1.

As shown in the drawings, the vehicular lamp 10 according to one or more embodiments of the present invention is a rear fog lamp disposed in the rear of a vehicle and includes a light-emitting element 12 disposed to face forward of the lamp, a translucent member 14 disposed to cover the light-emitting element 12 from the front side.

In the vehicular lamp 10 in FIG. 2, the direction indicated by X is "forward" ("rearward" for a vehicle), and the direction indicated by Y is "rightward direction" perpendicular to the "front" direction.

The light-emitting element 12 is a red light-emitting diode. The light-emitting center of a light-emitting chip 12*a* of the light-emitting element 12 faces forward of the lamp on an optical axis Ax that extends in the front-rear direction of the vehicle. In this state, the light-emitting element 12 is fixed to a support plate 16.

The translucent member 14 is composed of a transparent synthesis resin molding, and fixed to the support plate 16 via a bracket, not shown.

The translucent member 14 has a center region located forward of the light-emitting element 12 and serving as a direct light control portion 14A, and an annular peripheral region surrounding the direct light control portion 14A and serving as a reflecting light control portion 14B.

In the translucent member 14, among light emitted from the light-emitting element 12, the light emitted at a small angle (for example, an angle about 40° or less) with respect to the optical axis Ax is incident on the direct light control portion 14A, and the light emitted at a large angle (for example, an angle over 40°) with respect to the optical axis Ax is incident on the reflecting light control portion 14B.

The direct light control portion 14A is formed in the shape of a double-convex lens, and deflects and emits the light emitted from the light-emitting element 12 forward.

A front surface 14Aa of the direct light control portion 14A has an oval spherical curved surface whose curvature in the vertical direction is larger than that in the lateral direction. In contrast, a rear surface 14Ab of the direct light control portion 14A has a surface of revolution having the optical axis Ax as the center. The surface of revolution is a curved surface whose curvature gradually increases as the distance from the optical axis Ax increases.

Since the rear surface 14Ab of the direct light control portion 14A is composed of the surface of revolution as described above, the light emitted from the direct light control portion 14A diffuses relatively largely in the radial direction about the optical axis Ax in an area where the angle from the optical axis Ax is small. In the area where the angle from the optical axis Ax is large, the light emitted from the direct light control portion 14A diffuses relatively small and the degree of the diffusion gradually decreases as the angle from the optical axis Ax increases.

Since the front surface 14Aa of the direct light control portion 14A is composed of the oval spherical curved surface as described above, the degree of diffusion of the light emitted from the direct light control portion 14A is smaller in the vertical direction than in the lateral direction.

The reflecting light control portion 14B has an incident surface 14Bc on which the light emitted from the light-emitting element 12 is incident, a reflection surface 14Bb by which the light incident on the incident surface 14Bc is internally reflected forward, and an emission surface 14Ba from which the reflecting light from the reflection surface 14Bb is emitted forward.

In a plane including the optical axis Ax, the light emitted from the light-emitting element 12 is incident on the incident surface 14Bc and heads diagonally forward with respect to the optical axis Ax as parallel light. The parallel light is totally reflected by the reflection surface 14Bb as parallel light heading in the front direction of the lamp. The parallel light is emitted from the emission surface 14Ba as diffusion light centered around the front direction of the lamp.

The reflection surface 14Bb and the emission surface 14Ba are formed so as to extend diagonally forward in a stepwise manner in the plane including the optical axis Ax. The emission surface 14Ba is composed of a plurality of fan-like regions which are formed by circumferentially dividing concentric belt-like regions having the optical axis Ax as the center, and a diffusion lens element 14Ba1 in the shape of a fish eye lens is attached to each of the fan-like regions. The reflection surface 14Bb is composed of a plurality of conical surface regions 14Bb1. The conical surface regions 14Bb1 are each disposed behind the corresponding belt-like region of the emission surface 14Ba.

Figures 4A, 4B, 4C, 4D, 4E, 4F:
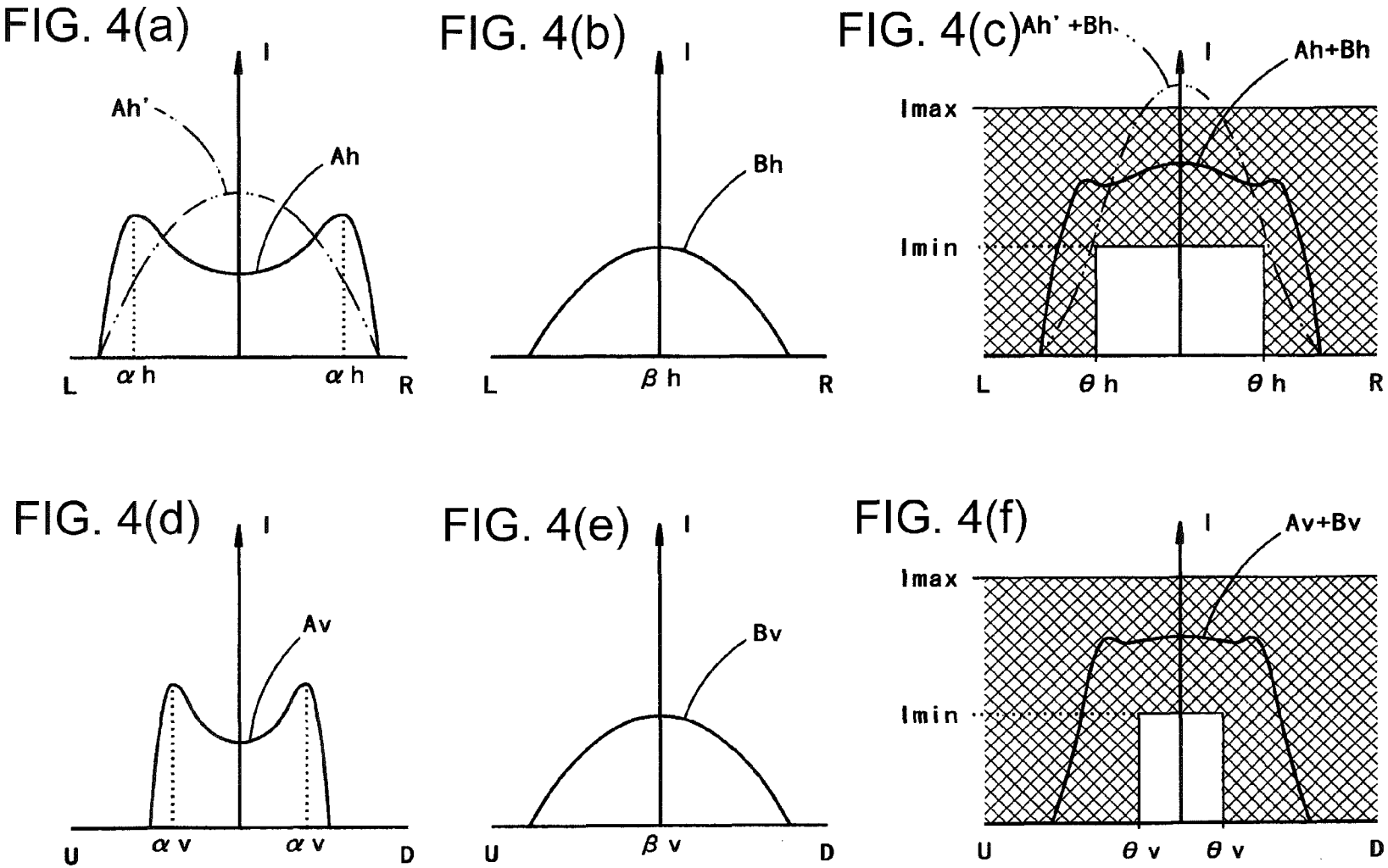
FIGS. 4(*a*)-4(*f*) show light intensity distributions of light emitted from the vehicular lamp.

FIGS. 4(*a*)-4(*f*) are drawings showing light intensity distributions of light emitted from the vehicular lamp 10.

FIGS. 4(*a*) to 4(*c*) show light intensity distributions in the horizontal direction, and FIGS. 4(*d*) to 4(*f*) show light intensity distributions in the vertical direction. In FIGS. 4(*a*) to 4(*c*), "L" represents the leftward direction, and "R" represents the rightward direction. In FIGS. 4(*d*) to 4(*f*), "U" represents the upward direction, and "D" represents the downward direction.

Firstly, the light intensity distributions in the horizontal direction will be described.

FIG. 4(*a*) shows a light intensity distribution Ah of the light emitted from the direct light control portion 14A.

In the light intensity distribution Ah, light intensity I is highest in directions leftward and rightward of the front direction of the lamp by a first required angle αh. The region within the angles shows a light intensity distribution that is recessed in a concave curve shape.

This is because the surface of revolution composing the rear surface 14Ab of the direct light control portion 14A is a curved surface whose curvature gradually increases as the distance from the optical axis Ax increases, and thus the degree of diffusion gradually decreases as the angle from the optical axis Ax increases.

In FIG. 4(*a*), light intensity distribution Ah' showed by a chain double-dashed line shows a light intensity distribution in a hypothetical case where the direct light control portion 14A is formed as an ordinary plane-convex lens. In the light intensity distribution Ah', the light intensity I is highest in the front direction of the lamp.

FIG. 4(*b*) shows a light intensity distribution Bh of the light emitted from the reflecting light control portion 14B.

In the light intensity distribution Bh, the light intensity I is highest in the front direction of the lamp. That is, in the light intensity distribution Bh, the light intensity I is highest in directions at a second required angle βh that is smaller than the first required angle αh. The value of the second required angle βh is set to be 0°.

FIG. 4(*c*) shows a synthesized light intensity distribution Ah+Bh (or light intensity distribution of light emitted from the entire vehicular lamp 10) of the light intensity distribution Ah of the light emitted from the direct light control portion 14A and the light intensity distribution Bh of the light emitted from the reflecting light control portion 14B.

The light intensity distribution Ah+Bh is overall relatively flat because the concave portion of the light intensity distribution Ah is offset by the convex portion of the light intensity distribution Bh.

In FIG. 4(*c*), the double hatched light intensity region shows a range of preferable light intensity distribution for rear fog lamps. In the double hatched light intensity region, the light intensity I is lower than the maximum light intensity Imax, and is higher than the minimum light intensity Imin within the angular range that extends leftward and rightward of the front direction of the lamp up to an angle θh (for example, θh=10°).

The light intensity distribution Ah+Bh is sufficiently included in the double hatched light intensity region.

A light intensity distribution Ah'+Bh shown by a chain double-dashed line in FIG. 4(*c*) shows a light intensity distribution in a hypothetical case where the direct light control portion 14A is formed as an ordinary plane-convex lens. In the light intensity distribution Ah'+Bh, the convex portion of the light intensity distribution Ah' is superimposed on the convex portion of the light intensity distribution Bh. The light intensity I is thus very high in the front direction of the lamp, and part of the light intensity distribution is out of the double hatched light intensity region.

Next, the light intensity distributions in the vertical direction will be described.

FIG. 4(*d*) is a light intensity distribution Av of the light emitted from the direct light control portion 14A.

In the light intensity distribution Av, the light intensity I is highest in directions upward and downward of the front direction of the lamp by a first required angle αv. The region within the angles shows a light intensity distribution that is recessed in a concave curve shape.

The reason for such a light intensity distribution Av is the same as the case of the light intensity distribution Ah in the horizontal direction. In the light intensity distribution Av, the first required angle αv is smaller than the first required angle αh.

This is because the front surface 14Aa of the direct light control portion 14A is the oval spherical curved surface whose curvature in the vertical direction is larger than that in the lateral direction, and the degree of diffusion of the light emitted from the direct light control portion 14A is thus smaller in the vertical direction than in the lateral direction.

FIG. 4(*e*) shows a light intensity distribution Bv of light emitted from the reflecting light control portion 14B.

The light intensity distribution Bv is the same as the light intensity distribution Bh. The value of a second required angle βv at which the light intensity I is highest is 0°.

FIG. 4(*f*) shows a synthesized light intensity distribution Av+Bv of the light intensity distribution Av of light emitted from the direct light control portion 14A and the light intensity distribution Bv of the light emitted from the reflecting light control portion 14B (i.e. light intensity distribution of light emitted from the entire vehicular lamp 10).

The light intensity distribution Av+Bv is overall relatively flat because the concave portion of the light intensity distribution Av is offset by the convex portion of the light intensity distribution Bv.

In FIG. 4(*f*), the double hatched region shows a range of preferable light intensity distribution for rear fog lamps, similarly to the double hatched light intensity region in FIG. 4(*c*). Note that in this double hatched light intensity region, the light intensity I is higher than the minimum light intensity Imin within an angular range that is extends upward and downward from the front direction of the lamp up to an angle θv (for example, θv=5°) which is smaller than the angle θh.

The light intensity distribution Av+Bv is sufficiently included in the double hatched light intensity region.

As described above, the vehicular lamp 10 emits light with relatively uniform luminous intensity within a certain angular range from the front direction of the lamp.

The translucent member 14 of the vehicular lamp 10 according to one or more embodiments of the present invention has a center region serving as the lens-like direct light control portion 14A, and a peripheral region serving as the reflecting light control portion 14B. The direct light control portion 14A is formed such that in the light intensity distributions Ah, Av of the light emitted from the direct light control portion 14A, the light intensity I is highest in directions that are at the first required angles αh, αv from the front direction of the lamp. The reflecting light control portion 14B is formed such that in the light intensity distributions Bh, Bv of the light emitted from the reflecting light control portion

14*b*, the light intensity I is highest in directions that are at the second required angles βh, βv from the front direction of the lamp.

Synthesizing the light intensity distributions Ah, Av of the light emitted from the direct light control portion 14A and the light intensity distributions Bh, Bv of the light emitted from the reflecting light control portion 14B brings the light intensity distributions Ah+Bh, Av+Bv, which are overall relatively flat light intensity distributions. This allows light emission with relatively uniform luminous intensity in a certain angular range from the front direction of the lamp.

According to one or more embodiments of the present invention, the vehicular lamp 10, which has the translucent member 14 provided with the direct light control portion 14A and the reflecting light control portion 14B, can thus emit light with relatively uniform luminous intensity in a certain angular range from the front direction of the lamp.

Moreover, in one or more embodiments of the present invention, the values of the first required angles αh, αv from the front direction of the lamp are set such that the vertical angle αv is smaller than the horizontal angle αh. Thus, it is possible to form the light distribution pattern, in which light is distributed with relatively uniform luminous intensity within a certain angular range from the front direction of the lamp, into a horizontally long light distribution pattern. This makes it possible to obtain a light distribution pattern more suitable for rear fog lamps.

In one or more embodiments of the present invention, the values of the second required angles βh, βv are set to 0°, so that the light distribution pattern are formed into a light distribution pattern having more uniform luminous intensity.

In one or more embodiments of the present invention, the direct light control portion 14A is formed in the shape of a double-convex lens, so that light from the light-emitting element 12 can be easily refracted at the rear surface 14Ab and the front surface 14Aa of the direct light control portion 14A. This allows fine control of light deflection by which in the light intensity distributions Ah, Av of the light emitted from the direct light control portion 14A, the light intensity I is highest in the directions that are at the first required angles αh, αv from the front direction of the lamp.

Although one or more embodiments of the present invention was described using a case where the direct light control portion 14A is formed in the shape of a double-convex lens, a direct light control portion formed in the shape of a plane-convex lens or a convex meniscus lens may also be used.

Although a case where the vehicular lamp 10 is a rear fog lamp provided in the rear of the vehicle is described above, one or more embodiments of the present invention may be applied to other portions of the vehicle. For example, the vehicular lamp 10 can be used as a tail lamp, a stop lamp, a daytime running lamp, and a clearance lamp in addition to a rear fog lamp. In such cases, white and umber light-emitting diodes can be used according to the functions of these lamps besides red light-emitting diode.

Next, a modification of one or more of the above embodiments will be described.

Figure 5:
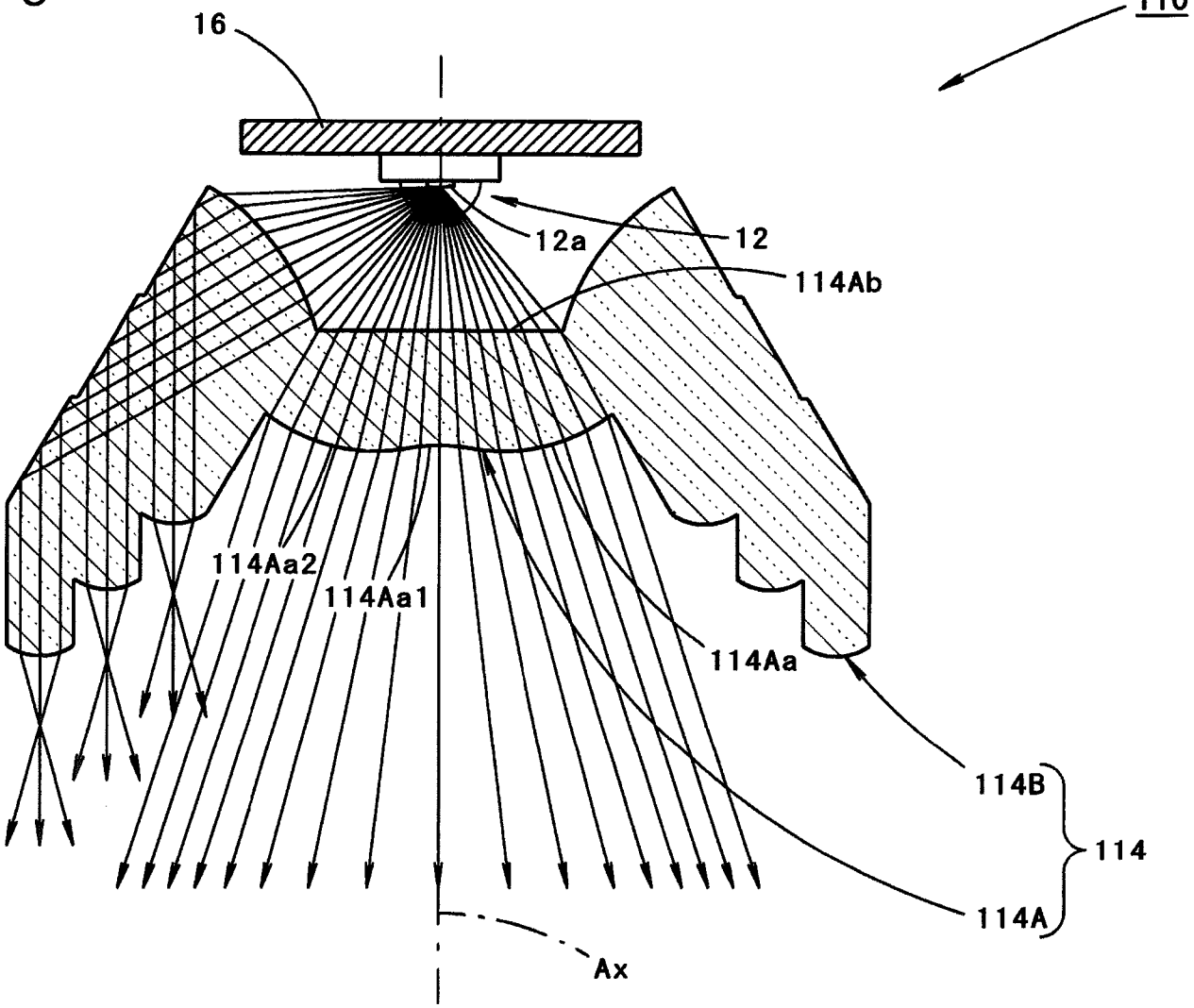
FIG. 5 is a view similar to FIG. 2 and showing a vehicular lamp according to a modification of one or more embodiments of the present invention.
Figure 6:
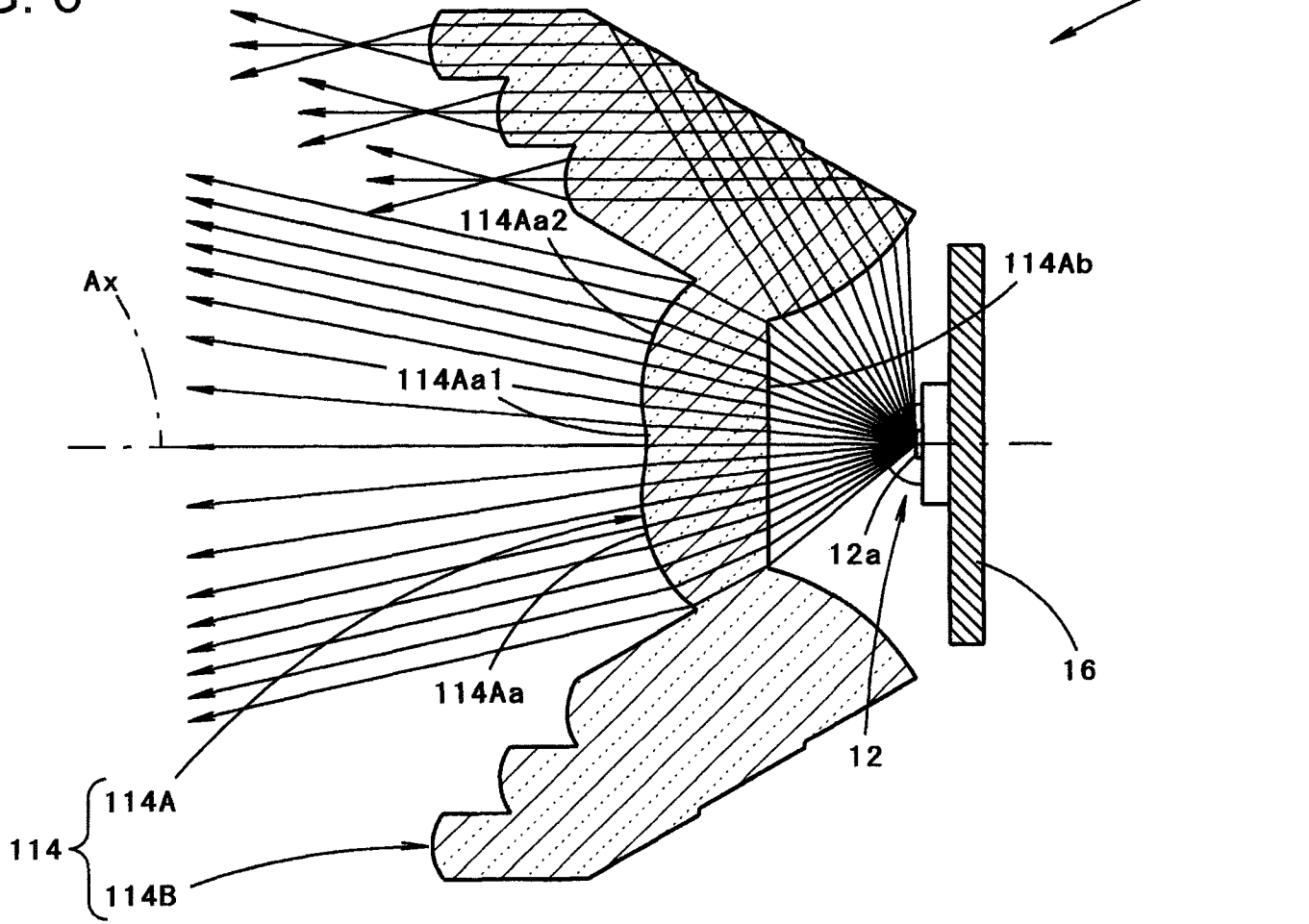
FIG. 6 is a view similar to FIG. 3 and showing a vehicular lamp according to the modification.

FIGS. 5 and 6 show views similar to FIGS. 2 and 3, respectively, and show a vehicular lamp 110 according to the modification.

As shown in the figures, the vehicular lamp 110 according to the modification is similar to one or more of the above embodiments in its basic structure, but the structure of a translucent member 114 is partially different from one or more of the above embodiments.

That is, in the translucent member 114 of the modification, although a reflecting light control portion 114B that constitutes the peripheral region of the translucent member 114 has the same shape as the reflecting light control portion 14B described above, a direct light control portion 114A that constitutes the center region of the translucent member 114 has a different shape from the direct light control portion 14A described above.

Specifically, the direct light control portion 114A has a front surface 114Aa in which a center region is formed of a concave curved surface 114Aa1 and a peripheral region is formed of a convex curved surface 114Aa2. The concave curved surface 114Aa1 is smoothly connected to the convex curved surface 114Aa2. In each of the concave curved surface 114Aa1 and the convex curved surface 114Aa2, curvature in the vertical direction is set to be larger than that in the lateral direction.

In contrast, a rear surface 114Ab of the direct light control portion 114A is composed of a flat surface orthogonal to the optical axis Ax.

The convex curved surface 114Aa2 in the front surface 114Aa of the direct light control portion 114A emits light that has reached the convex curved surface 114Aa2 such that the light diffuses largely in the radial direction about the optical axis Ax in an area where angles from the optical axis Ax are small, and is nearly parallel light in an area where angles from the optical axis Ax are large.

Figures 7A, 7B, 7C, 7D, 7E, 7F:
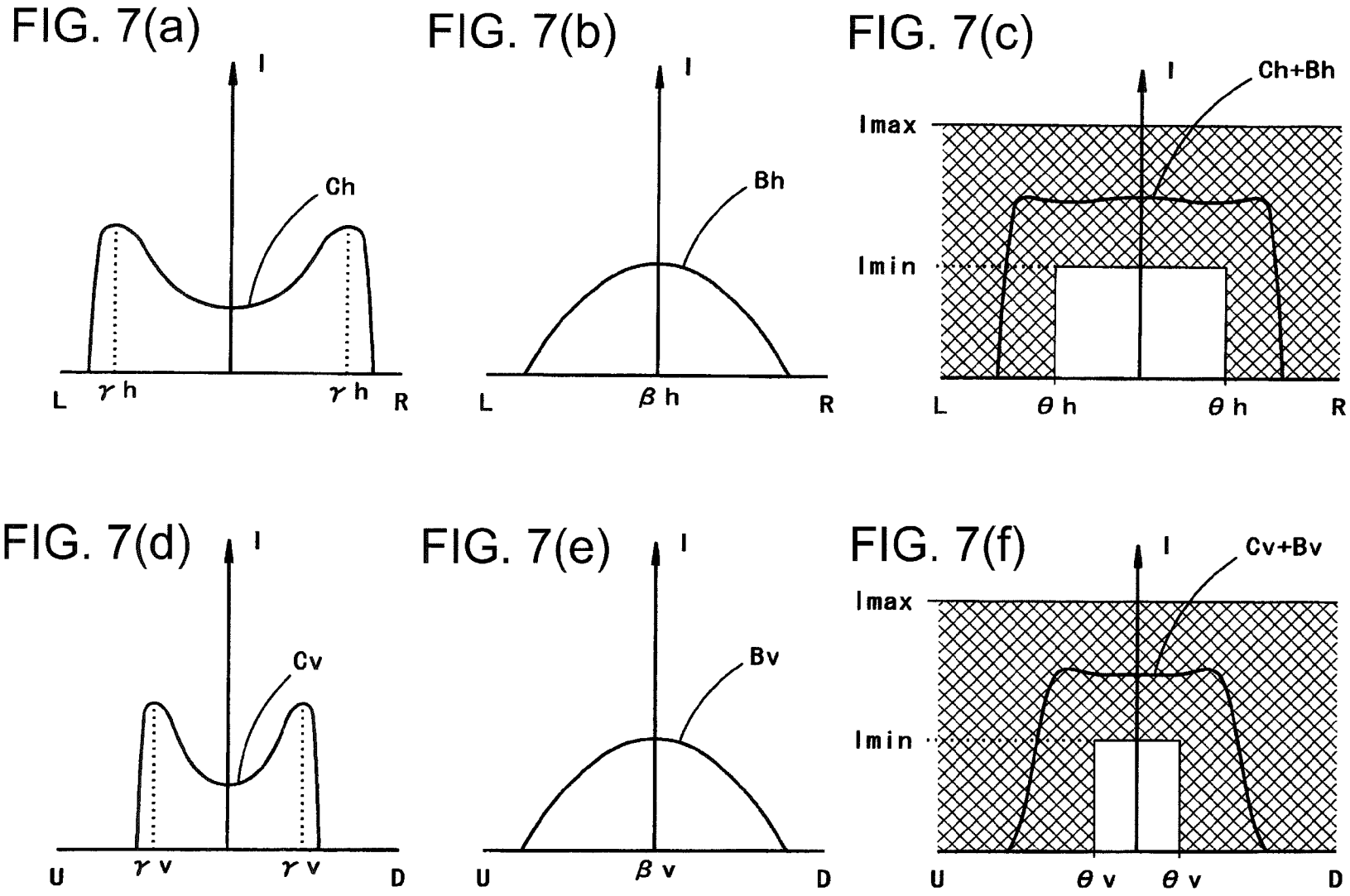
FIGS. 7(*a*)-7(*f*) show light intensity distributions of light emitted from the vehicular lamp according to the modification.

FIGS. 7(*a*)-7(*f*) are drawings similar to FIG. 4 and shows light intensity distributions of light emitted from the vehicular lamp 110.

FIGS. 7(*a*) to 7(*c*) show light intensity distributions in the horizontal direction, and FIGS. 4(*d*) to 4(*f*) show light intensity distributions in the vertical direction.

Firstly, the light intensity distributions in the horizontal direction will be described.

FIG. 7(*a*) shows a light intensity distribution Ch of the light emitted from the direct light control portion 114A.

In the light intensity distribution Ch, the light intensity I is highest in directions leftward and rightward of the front direction of the lamp by a first required angle γh. The region within the angles shows a light intensity distribution that is recessed in a concave curve shape. With respect to the first required angle αh described above, the first required angle γh is set to be larger than αh.

This is because the proportion of light in the directions that are at the first required angle γh from the front direction of the lamp is increased due to the configuration in which the center region in the front surface 114Aa of the direct light control portion 114A formed of the concave curved surface 114Aa1 and the peripheral region of the direct light control portion 114A formed of the convex curved surface 114Aa2. Therefore, in the light intensity distribution Ch, inclination is steep at the both left and right ends.

FIG. 7(*b*) shows the light intensity distribution Bh of the light emitted from the reflecting light control portion 114B. The light intensity distribution Bh may be similar to one or more of the above embodiments.

FIG. 7(*c*) shows a synthesized light intensity distribution Ch+Bh of the light intensity distribution Ch of the light emitted from the direct light control portion 114A and the light intensity distribution Bh of the light emitted from the reflecting light control portion 114B (i.e. light intensity distribution of light emitted from the entire vehicular lamp 110).

The light intensity distribution Ch+Bh is overall flatter and closer to a rectangle as compared to the light distribution Ah+Bh, because the concave portion of the light intensity distribution Ch is offset by the convex portion of the light intensity distribution Bh. The light intensity distribution Ch+Bh is sufficiently included in the double hatched light intensity region.

Next, the light intensity distribution in the vertical direction will be described.

FIG. 7(*d*) is a light intensity distribution Cv of the light emitted from the direct light control portion 114A.

In the light intensity distribution Cv, the light intensity I is highest in directions upward and downward of the front direction of the lamp by a first required angle γv. The region within the angles shows a light intensity distribution that is recessed in a concave curve shape.

The reason for such a light intensity distribution Cv is the same as the case of the light intensity distribution Ch in the horizontal direction. In the light intensity distribution Cv, the first required angle γv is smaller than the first required angle γh.

The concave curved surface 114Aa1 and the convex curved surface 114Aa2 which compose the front surface 114Aa of the direct light control portion 114A each have curvature set to be larger in the vertical direction than in the lateral direction. The degree of diffusion of the light emitted from the direct light control portion 114A is thus smaller in the vertical direction than in the lateral direction.

FIG. 7(*e*) shows the light intensity distribution Bv of light emitted from the reflecting light control portion 114B. The light intensity distribution Bv is the same as the light intensity distribution Bh. The value of the second required angle βv at which the light intensity I is highest is 0°.

FIG. 7(*f*) shows a synthesized light intensity distribution Cv+Bv of the light intensity distribution Cv of light emitted from the direct light control portion 114A and the light intensity distribution Bv of the light emitted from the reflecting light control portion 114B (i.e. light intensity distribution of light emitted from the entire vehicular lamp 110).

The light intensity distribution Cv+Bv is overall flatter and closer to a rectangle as compared to the light distribution Av+Bv because the concave portion of the light intensity distribution Cv is offset by the convex portion of the light intensity distribution Bv. The light intensity distribution Cv+Bv is sufficiently included in the double hatched light intensity region.

If the configuration of the modification is adopted, light can be emitted with more uniform luminous intensity in a certain angular range from the front direction of the lamp.

According to the modification, the direct light control portion 114A has the front surface 114Aa which has the concave curved surface 114Aa1 and the convex curved surface 114Aa2, and the rear surface 114Ab which is a flat surface. The rear surface 114Ab, however, may have a convex curved surface or a concave curved surface. Alternatively, the front surface 114Aa of the direct light control portion 114A may be a flat surface and the rear surface 114Ab thereof may be a concave curved surface and a convex curved surface.

Above, the numerical values shown as specifications are a mere example. It is a matter of course that any different values may be set for the specifications as appropriate.

The present invention should not be limited to the configurations described above, and can adopt configurations to which various changes other than the above embodiments and modifications.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

DESCRIPTION OF THE REFERENCE NUMERALS

10, 110 VEHICULAR LAMP
12 LIGHT-EMITTING ELEMENT
12*a* LIGHT-EMITTING CHIP
14, 114 TRANSLUCENT MEMBER
14A, 114A DIRECT LIGHT CONTROL PORTION
14Aa, 114Aa FRONT SURFACE
14Ab, 114AB REAR SURFACE
14B, 114B REFLECTING LIGHT CONTROL PORTION
14Ba EMISSION SURFACE
14Ba1 DIFFUSION LENS ELEMENT
14Bb REFLECTION SURFACE
14Bb1 CONICAL SURFACE REGION
14Bc INCIDENT SURFACE
16 SUPPORT PLATE
114Aa1 CONCAVE CURVED SURFACE
114Aa2 CONVEX CURVED SURFACE
Ah, Ah+Bh, Av, Av+Bv, Bh, Bv, Ch, Ch+Bh, Cv, Cv+Bv LIGHT INTENSITY DISTRIBUTION
Ax OPTICAL AXIS
I LIGHT INTENSITY
Imax HIGHEST LIGHT INTENSITY
Imin LOWEST LIGHT INTENSITY
αh, αv, γh, γv FIRST REQUIRED ANGLE
βh, βv SECOND REQUIRED ANGLE
θh, θv ANGLE

The invention claimed is:

1. A vehicular lamp comprising:

a light-emitting element facing a forward direction of the lamp, and a translucent member that covers the light-emitting element from a front side, wherein the translucent member has a center region located forward of the light-emitting element that serves as a lens-like direct light control portion, wherein the translucent member has a peripheral region surrounding the center region that serves as a reflecting light control portion in which light emitted from the light-emitting element and incident on the translucent member is internally reflected forward by a rear surface of the translucent member and emitted forward from a front surface of the translucent member, wherein the direct light control portion is configured such that light emitted from the direct light control portion has a light intensity distribution in which light intensity is highest in a direction at a first required angle from the forward direction of the lamp, and wherein the reflecting light control portion is configured such that light emitted from the reflecting light control portion has a light intensity distribution in which light intensity is highest in a direction at a second required angle that is smaller than the first required angle.

2. The vehicular lamp according to claim 1, wherein a value of the first required angle is set such that a horizontal angle from the front direction of the lamp is smaller than a vertical angle from the front direction of the lamp.

3. The vehicular lamp according to claim 1, wherein a value of the second required angle is set to 0°.

4. The vehicular lamp according to claim 1,
wherein the direct light control portion is formed in the shape of a double convex lens.

5. The vehicular lamp according to claim 2,
wherein a value of the second required angle is set to 0°.

6. The vehicular lamp according to claim 2,
wherein the direct light control portion is formed in the shape of a double convex lens.

7. The vehicular lamp according to claim 3,
wherein the direct light control portion is formed in the shape of a double convex lens.

* * * * *